US005302498A

United States Patent [19]

Southby et al.

[11] Patent Number: 5,302,498

[45] Date of Patent: Apr. 12, 1994

[54] ELEMENT AND PROCESS FOR PHOTOGRAPHIC DEVELOPER REPLENISHMENT

[75] Inventors: David T. Southby; John Texter, both of Rochester, N.Y.; Timothy Glover, London, United Kingdom

[73] Assignee: Eastman Kodak Company, Rochester, N.Y.

[21] Appl. No.: 952,937

[22] Filed: Sep. 29, 1992

Related U.S. Application Data

[63] Continuation-in-part of Ser. No. 810,944, Dec. 19, 1991, Pat. No. 5,256,525.

[51] Int. Cl.[5] ..... G03C 1/42; G03C 5/31

[52] U.S. Cl. ..... 430/399; 430/405; 430/443; 430/448; 430/566; 430/959

[58] Field of Search ..... 430/399, 405, 443, 959, 430/448, 566

[56] References Cited

U.S. PATENT DOCUMENTS

| | | | |
|---|---|---|---|
| 786,535 | 4/1905 | Thomton et al. | 430/523 |
| 3,342,599 | 9/1967 | Reeves | 430/371 |
| 3,386,472 | 6/1968 | Szonntagh | 137/597 |
| 3,554,109 | 1/1971 | Street et al. | 354/298 |
| 3,559,555 | 2/1971 | Street et al. | 354/298 |
| 3,990,088 | 11/1976 | Takita | 354/298 |
| 4,046,571 | 9/1977 | Mertz | 430/438 |
| 4,060,418 | 11/1977 | Waxman et al. | 430/212 |
| 4,157,915 | 6/1979 | Hamaoka et al. | 430/505 |
| 4,198,151 | 4/1980 | Matsugo et al. | 354/298 |
| 4,248,962 | 2/1981 | Lau | 430/382 |
| 4,348,475 | 9/1982 | Wernicke et al. | 430/399 |
| 4,420,556 | 12/1983 | Booms et al. | 430/549 |
| 4,439,520 | 3/1984 | Kofron et al. | 430/434 |
| 4,482,629 | 11/1984 | Nakagawa et al. | 430/542 |
| 4,741,994 | 5/1988 | Ichijima et al. | 430/549 |
| 4,772,537 | 9/1988 | Itoh et al. | 430/219 |
| 4,923,789 | 5/1990 | Yagihara et al. | 430/517 |
| 5,019,492 | 5/1991 | Buchanan et al. | 430/543 |
| 5,034,311 | 7/1991 | Slusarek et al. | 430/544 |
| 5,055,385 | 10/1991 | Slusarek et al. | 430/544 |
| 5,210,007 | 5/1993 | Texter et al. | 430/405 |
| 5,240,821 | 8/1993 | Texter et al. | 430/405 |
| 5,256,525 | 10/1993 | Southby et al. | 430/405 |

FOREIGN PATENT DOCUMENTS

| | | | |
|---|---|---|---|
| 3-266831 | 11/1991 | Japan | 430/399 |
| 1201/1888 | 1/1888 | United Kingdom . | |
| 26066/1905 | 10/1906 | United Kingdom . | |
| 13835/1907 | 6/1908 | United Kingdom . | |
| 24667/1907 | 8/1908 | United Kingdom . | |
| 1469004 | 3/1977 | United Kingdom . | |

*Primary Examiner*—Charles L. Bowers, Jr.
*Assistant Examiner*—Mark F. Huff
*Attorney, Agent, or Firm*—Foley & Lardner

[57] ABSTRACT

A photographic element including a support bearing at least one photographic silver halide emulsion layer and bearing on the opposite side of the support a layer containing at least one blocked developing agent or precursor thereof provides automatic developing agent replenishment of the developing bath upon processing.

27 Claims, 2 Drawing Sheets

ELEMENT AND PROCESS FOR PHOTOGRAPHIC DEVELOPER REPLENISHMENT

RELATED APPLICATIONS

This application is a continuation-in-part of U.S. application Ser. No. 07/810,944, filed Dec. 19, 1991 (Southby et al.), now U.S. Pat. No. 5,256,525 and is related to copending, commonly-assigned U.S. applications Ser. No. 07/810,241 (Buchanan et al.), 07/810,232 (Texter et al.), now U.S. Pat. No. 5,240,821 and 7/810,322 (Texter et al.), now U.S. Pat. No. 5,210,007 filed simultaneously therewith. The entire disclosures of each of the foregoing applications are herein incorporated by reference.

BACKGROUND OF THE INVENTION

This invention pertains to photographic elements, and in particular to photographic elements incorporating blocked photographic developers in a novel arrangement of layers.

It is well known in the art that the introduction of conventional color developers, such as p-aminophenols, into sensitized photographic elements containing silver halide salts, leads to desensitization of the silver halide emulsion and enhanced fog in such layers. Much effort has therefore been directed at trying to produce effective blocked developers, which can be introduced in silver halide emulsion elements without deleterious desensitization or fog effects and which unblock chemically under conditions of development so that developer is free to produce a normal silver image and/or participate in color forming (dye forming) reactions.

U.S. Pat. No. 3,342,599, to Reeves, discloses the use of Schiff base developer precursors. Schleigh and Faul, in a Research Disclosure (129 (1975) pp. 27–30), described the quaternary blocking of color developer and the acetamido blocking of p-phenylenediamines. Subsequently, U.S. Pat. No. 4,157,915, to Hamaoka et al., and U.S. Pat. No. 4,060,418, to Waxman and Mourning, describe the preparation and use of carbamat blocked p-phenylenediamines.

All of these approaches and inventions have failed in practical product applications because of one or more of the following problems desensitization of sensitized silver halide; unacceptably slow unblocking kinetics; instability of blocked developer yielding increased fog and/or decreased Dmax after storage.

Recent developments in blocking and switching chemistry have led to blocked p-phenylenediamines that perform well. In particular, compounds having "β-ketoester" type blocking groups (strictly, β-ketoacyl blocking groups) are described in U.S. Pat. No. 5,019,492. With the advent of the β-ketoester blocking chemistry, it has become possible to incorporate developers in film systems in a form from which they only become active when required for development.

The incorporation of these blocked developers in photographic elements is carried out using colloidal gelatin dispersions of the blocked developers. These dispersions can be prepared using any means well known in the art. For example, in one such method, the developer precursor is dissolved in a high vapor pressure organic solvent (for example, ethyl acetate), along with, in some cases, a low vapor pressure organic solvent (such as dibutylphthalate), and then emulsified with an aqueous surfactant and gelatin solution. After emulsification, usually done with a colloid mill, the high vapor pressure organic solvent is removed by evaporation or by washing, as is well known in the art. The β-ketoacyl blocked developers are released from the film layers in which they are incorporated by an alkaline developing solution containing a dinucleophile, for example hydroxylamine.

It has been known to the photographic art to coat a developer on the backs of plates, films and papers. In an early British Patent Specification (No. 1,201), Backelandt in 1888 disclosed the preparation of photographic plates, whereby the backs of the plates were entirely covered with a mixture comprising gallic acid or other reducing substance, salicylic acid, gum arabic, dextran, gelatin or other binder, alcohol, and water. After exposure, said plates were developed by dipping them into an aqueous ammonia solution or into a plain water solution (when half of the back of the plate had been coated with alkali in a suitable binder and when the other half of the back of the plate had been coated with the developing agents as described above). This reference showed how to incorporate sufficient developer in order to eliminate developer from the processing solution. The use of such plates, however, occasioned numerous difficulties arising from contact between the back side of one plate and the emulsion-bearing, light sensitive side of an adjacent plate in, for example, a magazine. These difficulties include mechanical scratching of one or both of the contacting layers, the desensitization of the contacted emulsion-bearing light sensitive layer by reducing agent diffusing from the adjacent incorporated developer layer, as well as difficulties from the thermal instability of the incorporated developer.

Thornton and Rothwell, in British Patent Specification No. 17,292 (April 1900), disclosed that fixing agents may in addition and in combination with developing agents be affixed to the back sides of photographic plates so that development and fixing may be done by placing the plate in a single water solution, after which the plate may be removed in daylight and subsequently washed free of residual chemicals.

In U.S. Pat. No. 786,535 (1905), Thornton and Rothwell disclosed preparation of similar back-coated plates and films, with the application of a further protective layer to the back side so as to overcome the foregoing deleterious effects of mechanical abrasion between adjacent plates, and further, to prevent oxygen from reaching the incorporated developer. Thornton and Rothwell, in U.S. Pat. No. 786,536 (1905), disclose a similar system applied to photographic paper used for producing prints from negatives.

Kelly, in British Patent Specification No. 13,835 (1907), and Bentham and Kelly, in British Patent Specification No. 26,066 (1905), disclosed the coating of a developing mixture comprised of metol (N-methyl-4aminophenol sulfate) and hydroquinone, in association with suitable borate-related compounds for pH control, to the back sides of plates, films, and printing-out papers. Development of the disclosed plates, films, and papers was obtained by placing them into a plain water solution, the required developer being acquired from that coated on the reverse sides.

Bolas, in British Patent Specification No. 24,667 (May 1907), disclosed the interposition of a neutral or inert or slightly acid preparation or sheet between the alkaline accelerator and the reducing agent.

Various automatic film processors adapted to develop, fix, wash, and dry sheets of light-sensitive material are known to those skilled in the art. Many forms of developer replenishment systems, manual and automatic, are known. For example, U.S. Pat. No. 3,386,472 describes the maintenance of a developer solution at a predetermined level of activity by delivering replenishment solution under the control of an electromechanical system.

Street et al., in U.S. Pat. Nos. 3,554,109 and 3,559,555, disclosed an image monitoring and control system for feeding replenishment chemicals to the film processor. The Street system is designed for use with sheets of image-bearing photosensitive materials.

Takita, in British Patent Specification No. 1,469,004 and in U.S. Pat. No. 3,990,088, respectively, disclosed a method for stabilizing developer activity in an automatic film processor. The disclosed method is designed to keep developer activity within certain prescribed control limits, and represents an improvement over the control process described by Street et al.

Matsugo, in U.S. Pat. No. 4,198,151, disclosed a developer replenishment system for developing photographic films. The system comprises means for automatically pumping developer replenishment solution from a reservoir to the development tank, in proportion to the width and length of film processed in the tank.

Mertz, in U.S. Pat. No. 4,046,571, disclosed a replenisher for use with a photographic developer bath. Said replenisher comprises a mixture of a 1-phenyl-3-pyrazolidone and a hydroquinone (or derivative thereof), bromide, speed restrainer, and buffer to provide a pH of 10 at 25° C.

Wernicke and Meckl, in U.S. Pat. No. 4,348,475, disclosed a process based on the regenerability of the developer.

Despite the technical sophistication of automatic developer solution replenishment systems, such systems continue to be susceptible to inaccuracy in development. For example, the known systems can exhibit a tendency to over-develop images for a short time immediately after addition of replenishment solution. Such systems also show gradual loss of activity during the time in which the developer solution is sitting idle and subject to aerial oxidation.

In conventional processors, replenishing developer solution is supplied directly to the developing tank, resulting in an instantaneous surge in developing activity, followed thereafter by a decrease in activity. This cyclical variation can result in uneven developed densities.

Whatever automated replenishment system is employed, extant processors require operators to mix and load developer solutions manually into replenisher tanks, thereby exposing the operators to the possibility of physically contacting the developer solutions. Such contact, in general, should be avoided.

When developers, developer precursors, and blocked developers are incorporated in emulsion layers containing silver halide or in layers in reactive association with silver halide, said developers can cause deleterious desensitization effects and unwanted incubation fog formation upon storage, prior to development.

Elements and processes involving the coating of unblocked developers, such as hydroquinone, on the back sides of films, plates, and papers suffer in that such developers are not stable with respect to oxidation during storage.

There has been a need for a photographic element incorporating a blocked developer which is stable until development. Then the element can be developed rapidly and easily. There has also been a need for a process for developing an image in a photographic element which employs a developing solution having a simplified composition.

There has also been a need for a process for developing an image in photographic elements by means of an automated apparatus whereby the activity of the developer in the developer bath is maintained constant by automated replenishment means. There has further been a need for a process which obviates the deleterious desensitization effects and unwanted incubation fog formation upon storage of the known systems. In addition, there has been a need for a process which avoids exposure of operators to potentially harmful developer solutions.

SUMMARY OF THE INVENTION

These and other needs have been satisfied by providing a photographic element comprising a support bearing at least one photographic silver halide emulsion layer and bearing on the opposite side thereof a layer containing at least one blocked developing agent or blocked developing agent precursor.

In a preferred embodiment, the blocked developing agent has a structure according to the formula (I):

$$D-(T)_m-S \qquad (I)$$

in which

D is a silver halide developer,

T is a timing group, m is an integer from 0 to 6 and denotes the number of timing groups connected in series, and is a blocking group.

In preferred embodiments, the blocking group is an acyl group, particularly preferably a $\beta$-ketoacyl group.

There is also provided a process for replenishing developing solution and developing an image in a photographic element as described above, having a photographic silver halide emulsion layer containing an imagewise distribution of developable silver halide grains, which comprises the step of contacting the element with a processing solution which comprises a nucleophile.

A process for producing the inventive photographic element is also provided.

BRIEF DESCRIPTION OF THE DRAWING

The invention may be more readily understood by referring to the accompanying drawing by which

DETAILED DESCRIPTION OF THE INVENTION

Figure 1:
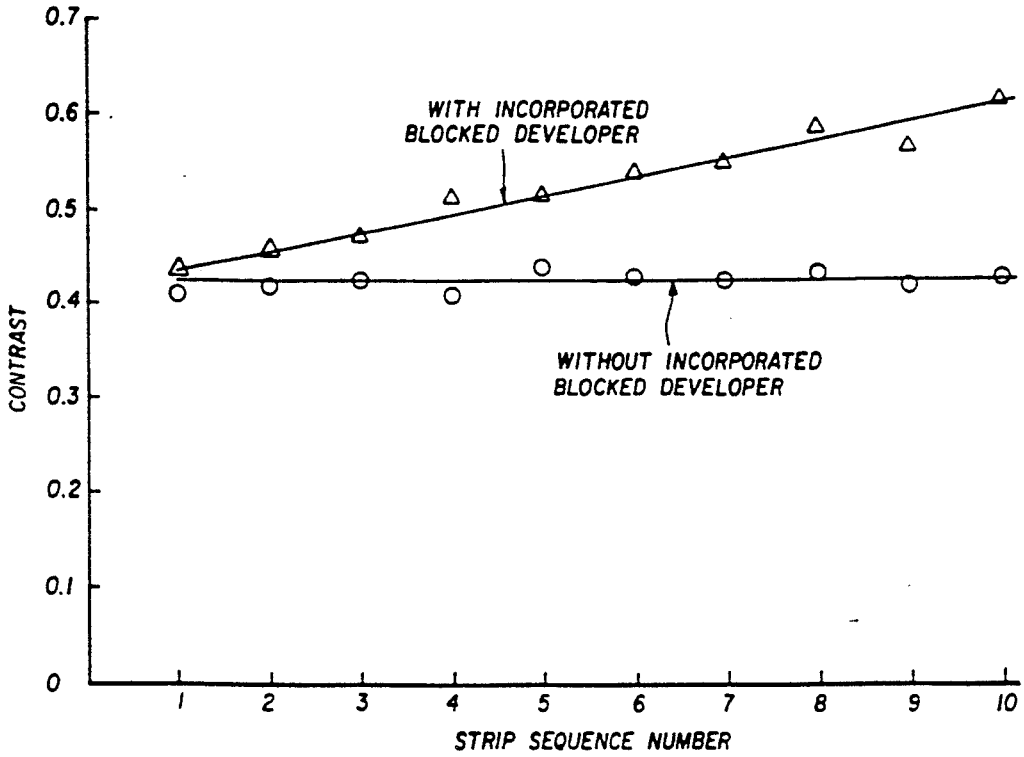
FIG. 1 is a comparison of contrasts obtained for sequences of strips (with and without incorporated blocked developer for automatic replenishment) processed in a color developer solution, wherein the level of color developer was about 0.1 times the amount used according to the prior art.

It has now been discovered that a photographic element having a blocked developing agent in a non-photosensitive layer disposed on the support on the opposite side to the photosensitive layer or layers, can provide completely automatic developing-agent replenishment of the developer bath upon processing. It has further been discovered that the use of β-ketoacyl blocked developing agents in the non-photosensitive layer is particularly advantageous. Use of simple acyl blocked developing agents is also advantageous.

The invention achieves simplification of the composition of the developing solution replenisher, in that incorporation of a developing agent into the photographic element leads to a reduction in the concentration of developing required in the replenisher to obtain a high quality dye image and uniform developer activity. The developer solution and replenisher are also utilized more efficiently.

Incorporation of blocked compounds in sensitized layers can lead to small but unwanted desensitization of the silver halide emulsion. Thus, separation of the emulsions and sensitized layers and blocked developers by coating the latter in a non-sensitized layer and not in reactive association with any sensitized layers of the photographic element overcomes this problem.

In a preferred embodiment, the blocked developing agent has a structure according to the formula (I):

$$D-(T)_m-S \qquad (I)$$

in which

D is a silver halide developer,

T is a timing group, m is an integer from 0 to 6 and denotes the number of timing groups connected in series, and S is a blocking group.

In formula I, the timing group(s), T, can contain one or more substituents to control tee aqueous solubility of the precursor compound. Exemplary timing groups are disclosed in U.S. Pat. Nos. 4,248,962; 4,482,629; 4,741,994; 4,772,537; 4,985,336; 5,019,492; 5,034,311; and 5,055,385, the entire disclosures of which are incorporated by reference. Up to six timing groups can be joined sequentially according to the invention (that is, m=0 to 6). Preferably, m=0, 1 or 2.

The blocking group S must have appropriate hydrolysis kinetics, that is, it must be a group that completely unblocks in the course of the development process. The blocking group S preferably is an acyl group, particularly a β-ketoacyl group as described in U.S. Pat. No. 5,019,492, or a simple acyl ester as described in U.S. patent application Ser. No. 07/810,241. Exemplary preferred blocking groups include:

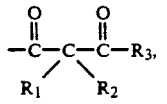

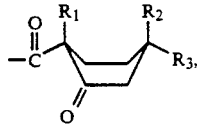

-continued

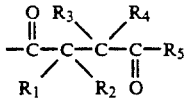

or

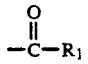

in which $R_1$, $R_2$, $R_3$, $R_4$ and $R_5$ individually are H or an unsubstituted or substituted alkyl group having 1 to 20 carbon atoms, and preferably are H or methyl. In the simple acyl blocking group, $R_1$ can be an unsubstituted or substituted alkyl, alkoxy, aryl or aryloxy group, as described in U.S. patent application Serial No. 07/810,241.

The group S can also contain one or more substituents to control the aqueous solubility of the developer precursor. Exemplary substituents can include halogen, alkyl, aryl, heterocyclic, cyano, alkoxy, aryloxy, acyl, acylamino, anilino, ureido, alkylthio, arylthio, alkoxycarbonylamino, sulfonamido, unsubstituted or substituted carbamoyl, sulfamoyl, sulfonyl, alkyoxycarbonyl, heterocyclic oxy, acyloxy, carbamoyloxy, aryloxycarbonylamino, imido, heterocyclic thio, sulfinyl, phosphonyl, aryloxycarbonyl, alkylsulfonyl, arylsulfonyl, hydroxy, carboxy, and sulfo groups, as well as others known to those skilled in the art. The timing group T can likewise be substituted.

Both the timing and blocking groups can be unballasted or ballasted. In other words, at least one of T and S can include a group of such molecular size and configuration as to render the present compound nondiffusible as described, for example, in U.S. Pat. Nos. 4,420,556 and 4,923,789. Advantageous ballast groups include alkyl and aryl groups having from about 8 to 32 carbon atoms.

In formula I, the silver halide developer D can preferably be a color developer. The silver halide color developer D preferably is of the p-phenylenediamine or p-aminophenol type. Preferred developers according to the invention are given below in Table I. These developers according to the invention are prepared by well-known techniques, such as those described in U.S. Pat. No. 5,019,492 and U.S. patent application Ser. Nos. 07/810,241 and 07/810,322. Additional techniques are described in U.S. Pat. No. 3,342,599, U.S. Pat. No. 4,060,418, and U.S. Pat. No. 4,157,915, the disclosures of each of which are incorporated in their entireties by reference.

The developer, D, like the timing and blocking groups, may contain one or more substituents to control the aqueous and/or oil solubility of the developer precursor. Typical substituents include alkyl, hydroxyalkyl, sulfonamidoalkyl, sulfoalkyl, sulfo and carboxyalkyl, as well as others previously listed and known to those skilled in the art.

The preferred color developer compounds include those of the p-phenylenediamine type described in Table I, and in addition include analogous aminophenol compounds. The aminophenol compounds have structures according to the following formulas:

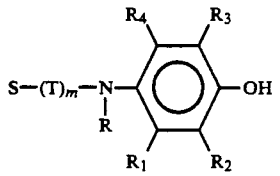

and

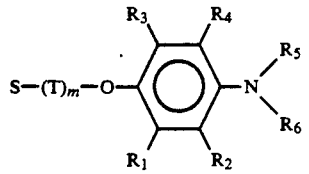

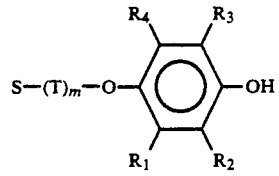

and

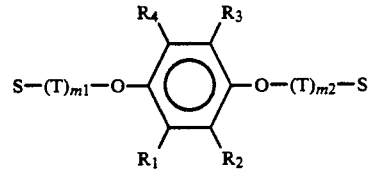

where S, T and m are as defined above. Here, R, $R_1$, $R_2$, $R_3$, $R_4$, $R_5$ and $R_6$ are independently H, halogen, alkyl, alkoxy, alkylsulfonamido, acylamido or aryl. Specific examples of such blocked aminophenols are listed in Table II.

Other blocked p-phenylenediamines of this invention include carbamate, oxamide, urea, thiourea, trihaloacetamido, perfluoroacyl, hydroxamic acid, and Schiff base derivatives. Examples of such blocked p-phenylenediamines are listed in Table III.

Other preferred developer compounds include those of the hydroquinone type and have structures according to the following formulas:

where S, T and m are defined above and $m_1$ and $m_2$ have the same definition as m. Here, $R_1$, $R_2$, $R_3$ and $R_4$ are independently H, halogen, alkyl, alkoxy, alkylsulfonamido, acylamido or aryl. Specific examples of such blocked hydroquinones are listed in Table IV.

Further modification of the rate of release of the developer from the timing groups may be obtained by using a wider range of timing group structures. This is advantageous in matching the rate of release of the developer more closely to the time of development of the photographic element. For example, Slusarek et al., U.S. Pat. Nos. 5,034,311 and 5,055,385, teach how the rate of release of photographically useful groups may be radically changed by changing the structure of one class of timing groups (quinone methides). Further examples of quinone methides and other classes of useful timing groups are given in Table V.

TABLE I

| W | Z | Y | X |
|---|---|---|---|
| | 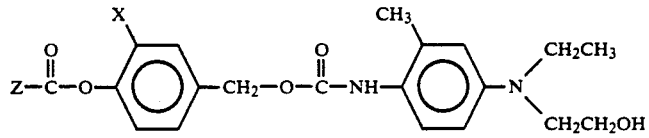 | | |
| 1 | $-C(CH_3)_2-CO-CH_3$ | | $-NHSO_2CH_3$ |
| 2 | $-C(CH_3)_2-CO-CH_3$ | | $-NHSO_2CH_2(CH_2)_{14}CH_3$ |
| 3 | $-C(CH_3)_2-CO-CH_3$ | | $-H$ |
| 4 | $-C(CH_3)_2-CO-CH_3$ | | $-NHCO(CH_2)_3CO_2C(CH_3)_3$ |
| 5 | $-C(CH_3)_2-CO-CH_3$ | | $-NHCO(CH_2)_3CO_2H$ |
| 6 | 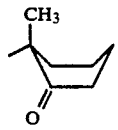 | | $-NHSO_2CH_3$ |
| 7 | $-CH(CH_3)_2$ | | $-H$ |
| | 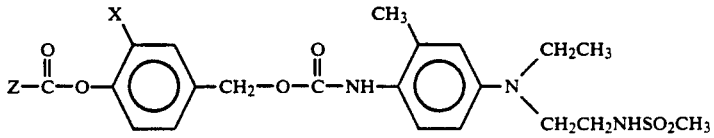 | | |
| 8 | $-C(CH_3)_2-CO-CH_3$ | | $-NHSO_2CH_3$ |
| 9 | $-C(CH_3)_3$ | | $-NHSO_2CH_3$ |

TABLE I-continued
| | W | Z | Y | X |
|---|---|---|---|---|
| 10 | | 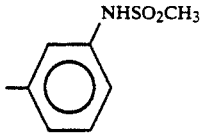 | | $-H$ |
| 11 | | $-CH(CH_3)_2$ | | $-NHCO(CH_2)_3CO_2H$ |
| 12 | | $-CH(CH_3)_2$ | | $-NHSO_2CH_3$ |
| 13 | | $-CH_2CH_3$ | | $-NHCO(CH_2)_3CO_2H$ |
| 14 | | 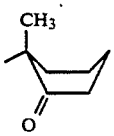 | | $-NHCO(CH_2)_3CO_2H$ |
| 15 | | $-CH_2CH_3$ | | 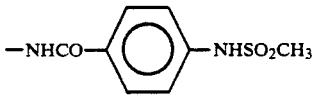 |
| 16 | | 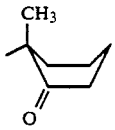 | | 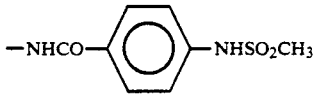 |
| 17 | | 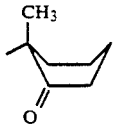 | | $-NHSO_2CH_3$ |
| | | 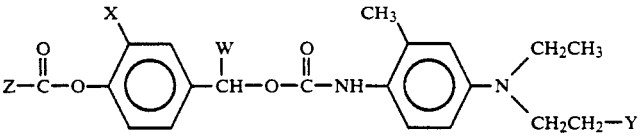 | | |
| 18 | $-H$ | $-CH_2CH_3$ | $-NHSO_2CH_3$ | 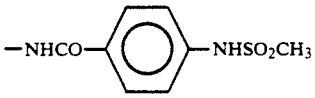 |
| 19 | $-H$ | $-CH_2CH_3$ | $-OH$ | 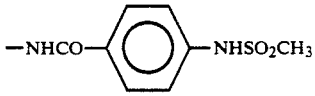 |
| 20 | $-H$ | $-CH_2CH_3$ | $-H$ | 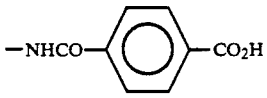 |
| 21 | $-H$ | $-CH_3$ | $-NHSO_2CH_3$ | 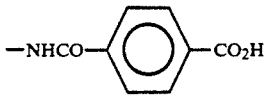 |
| 22 | $-H$ | $-CH_2CH_2CH_3$ | $-NHSO_2CH_3$ | 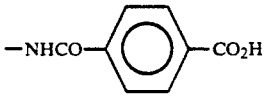 |
| 23 | $-H$ | $-CH(CH_3)_2$ | $-NHSO_2CH_3$ | 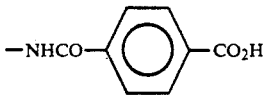 |

TABLE I-continued
| | W | Z | Y | X |
|---|---|---|---|---|
| 24 | —H | —$CH_2CH_3$ | —$NHSO_2CH_3$ | 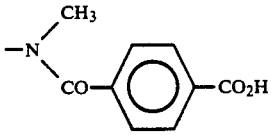 |
| 25 | —H | —$CH_2CH_3$ | —$NHSO_2CH_3$ | 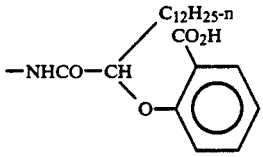 |
| 26 | —$CH_3$ | —$CH_2CH_3$ | —$NHSO_2CH_3$ | 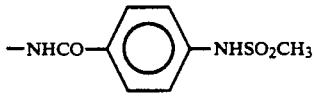 |
| 27 | —H | 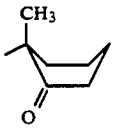 | —$NHSO_2CH_3$ | 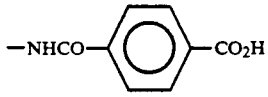 |
TABLE II
| | Z | X | R | $R_1$ | $R_2$ |
|---|---|---|---|---|---|
| | 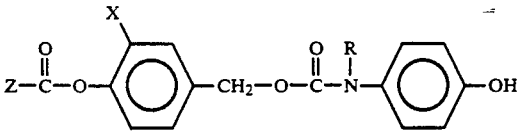 | | | | |
| 28 | —$C(CH_3)_2$—CO—$CH_3$ | —$NHSO_2CH_3$ | —$CH_2CH_3$ | | |
| 29 | —$C(CH_3)_2$—CO—$CH_3$ | —NH—CO—$(CH_2)_3CO_2H$ | —$CH_2CH_3$ | | |
| 30 | —$C(CH_3)_2$—CO—$CH_3$ | 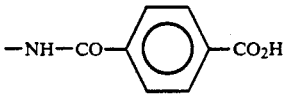 | —$CH_3$ | | |
| 31 | 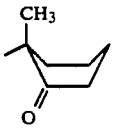 | 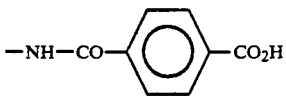 | —$CH_3$ | | |
| 32 | —$CH_2CH_3$ | 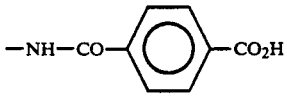 | —$CH_3$ | | |
| 33 | —$CH(CH_3)_2$ | —$NHSO_2CH_3$ | —$CH_2CH_3$ | | |
| 34 | —$CH(CH_3)_2$ | 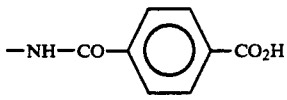 | —$CH_3$ | | |
| 35 | —$CH(CH_3)_2$ | 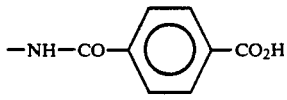 | —$CH_2CH_3$ | | |

TABLE II-continued
| | Z | X | R | $R_1$ | $R_2$ |
|---|---|---|---|---|---|
| | 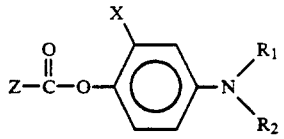 | | | | |
| 36 | $-CH_3$ | $-OCH_3$ | | $-CH_2CH_3$ | $-CH_2CH_3$ |
| 37 | $-CH(CH_3)_2$ | $-H$ | | $-CH_2CH_2OH$ | $-CH_2CH_3$ |
| 38 | $-CH_2CH_3$ | $-NHSO_2CH_3$ | | $-CH_3$ | $-CH_3$ |
| 39 | $-CH_2CH_3$ | $-H$ | | $-CH_2CH_3$ | $-CH_2CH_3$ |
TABLE III
40 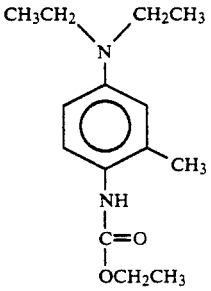
41 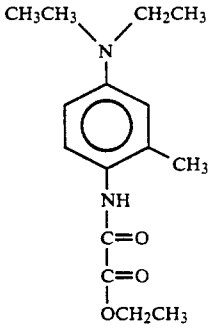
42 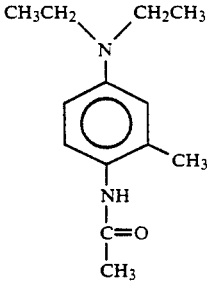
43 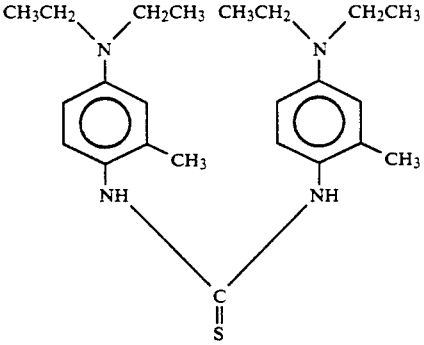
44 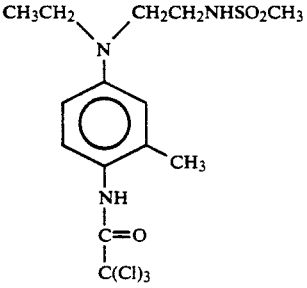
45 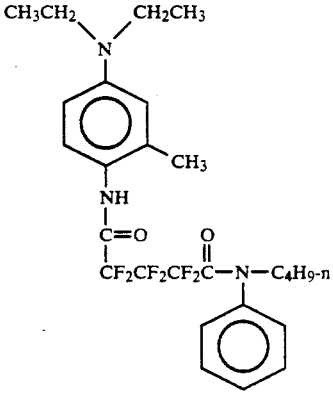

TABLE III-continued
46 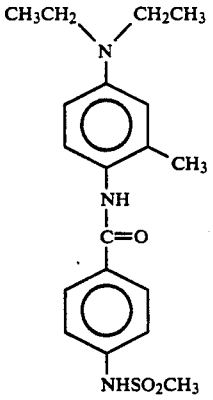
47 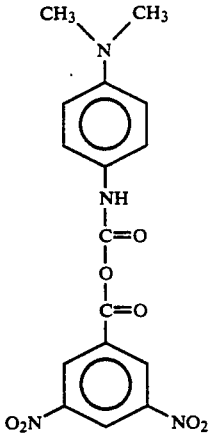
48 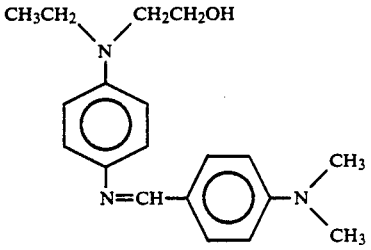
49 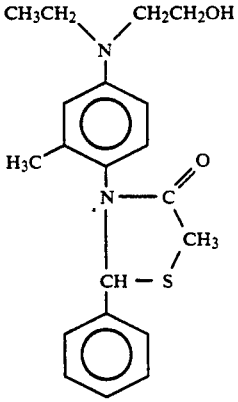
50 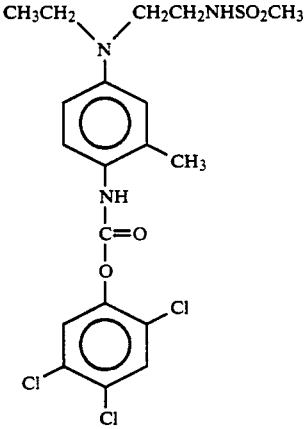
TABLE IV
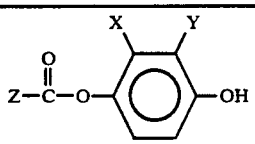
| | Z | X | Y |
|---|---|---|---|
| 51 | $-CH_3$ | $-OCH_3$ | $-H$ |
| 52 | $-CH(CH_3)_2$ | $-C(CH_3)_3$ | $-CH_3$ |
| 53 | $-C(CH_3)_3$ | $-Cl$ | $-H$ |
TABLE IV-continued
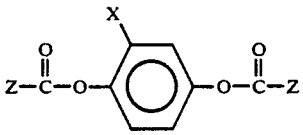
| | Z | Z | X |
|---|---|---|---|
| 54 | $-C(CH_3)_2COCH_3$ | $-C(CH_3)_2COCH_3$ | $-Cl$ |
| 55 | $-C(CH_3)_2COCH_3$ | 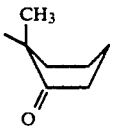 | $-C(CH_3)_3$ |

TABLE V

56

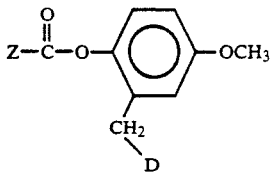

57

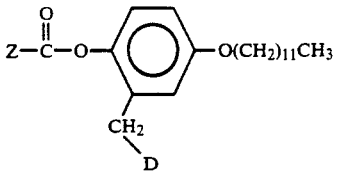

58

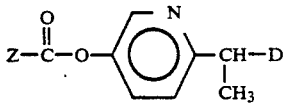

59

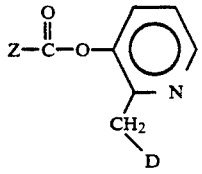

60*

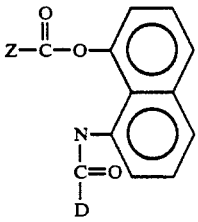

61*

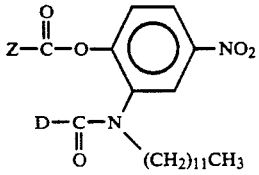

62

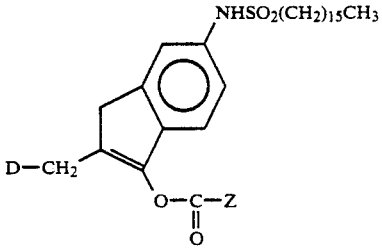

63

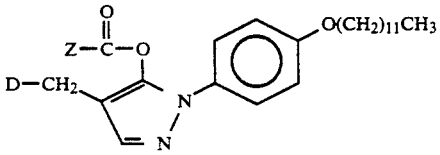

*D here represents only an aminophenol or hydroquinone linked through an oxygen atom.

In Table V, Z is as described in Tables I and II. D is an aminophenol or hydroquinone developer, linked to the timing group through an oxygen atom, or is O—CO—E, where E is a p-phenylenediamine developer, linked to the timing group through a nitrogen atom.

The blocked developing agents according to the present invention can be incorporated as a dispersion, including a dispersion of solid particles as described in U.S. patent application Ser. No. 07/810,232, U.S. Pat. No. 5,240,821. Another method is to add the blocked developer to a melt as a solution in an organic, water-miscible solvent. Other incorporation methods will be readily apparent to those skilled in the art.

The blocked developing agents according to the present invention are preferably present in an amount from about 0.001 to 100 g/m$^2$, particularly preferably about 0.1 to 20 g/m$^2$.

In the following discussion of suitable materials for use in the emulsions and elements according to the invention, reference will be made to *Research Disclosure,* December 1989, Item 308119, published by Kenneth Mason Publications Ltd., Emsworth, Hampshire PO10 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes.

The silver halide emulsions employed in the elements according to the invention can be either negative-working or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520. Suitable vehicles for the emulsion layers and other layers of elements according to the invention are described in Research Disclosure Section IX and the publications cited therein.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

In a particular embodiment, a photographic element according to the invention can include a layer comprising a blocked developer in reactive association with an imaging layer, as disclosed in U.S. patent application Ser. No. 07/810,944, U.S. Pat. No. 5,256,525. An advantage of this embodiment is that it provides enhanced development in the photographic layer or layers, with adequate replenishment from blocked developer coated on the other side of the film base.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. During processing, the developer precursor compound of formula I will generally be solubilized and undergo a sequence of reactions to release the color developer. Processing can be any type of known photographic processing, although it is preferably carried out at pH 9 to 14 and includes a nucleophile such as hydrogen peroxide, hydroxylamine, perborate, an alkyl peroxide, an aryl peroxide, or a compound releasing or providing such nucleophiles.

In particular, when S is a $\beta$-ketoacyl group, the nucleophile is a dinucleophile, as discussed in U.S. Pat. No. 5,019,492. When S is a simple acyl group, the nucleophile preferably is a peroxide having the structure $$R_7—OOH$$

in which $P_7$ is H or an unsubstituted or substituted alkyl, aryl, alkaryl, aralkyl or acyl group. $R_6$ can also be a sulfonyl, oxycarbonyl or borate group, or any group in general which hydrolyzes readily in alkaline solution to yield hydrogen peroxide. Hydrogen peroxide is the particularly preferred reagent (hydrogen peroxide is present as a salt in alkaline solution, that is, in the form $H—O—OM^+$, which is the active species).

A negative image can be developed by using one or more of the aforementioned nucleophiles. A positive image can be developed by first developing with a non-chromogenic developer, then uniformly fogging the element, and then developing by a process employing one or more of the aforementioned nucleophiles. If the material does not contain a color-forming coupler compound, dye images can be produced by incorporating a coupler in the developer solutions.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

EXAMPLE 1

The $\beta$-ketoacyl blocked developer 17 (Table I) was dispersed using ethyl acetate (2 parts by weight) to make a dispersion that was 3% (w/w) blocked developer and 4% (w/w) gelatin. A fine particle size dispersion was obtained using a colloid mill, as is well known in the art. This dispersion was used unwashed and included in layer C of the monochrome test format described in Table VI. Other constituents of this layer were gelatin, water, saponin, and hardener. Layer B contained a green sensitized silver bromoiodide emulsion and image coupler I-1. Layer A was a protective overcoat.

A control coating identical to that illustrated in Table VI was made, except that Layer C was omitted so that the control coating contained no incorporated blocked developer

TABLE VI

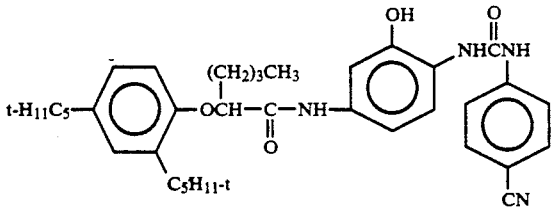

Coupler I-1

| | |
|---|---|
| DOC | Gelatin (3.55 g/m$^2$) |
| Layer A | 1,1'-(oxybis(methylenesulfonyl))bis-ethene hardener (1.2% of total gelatin) saponin (1.5% of melt volume) |
| EMULSION LAYER | Gelatin (2.15 g/m$^2$) Coupler I-1 (0.75 g/m$^2$) |
| Layer B | green sensitized AgBrI emulsion, 6.4 mol % iodide, with mean particle size about 0.46 μm (1.61 g/m$^2$ as Ag) saponin (1.5% of melt volume) |
| FILMBASE | (subbed with 0.32 g/m$^2$ gelatin on each side) |
| Layer C | Gelatin (2.47 g/m$^2$) β-ketoacyl blocked developer 17 (0.99 mmol/m$^2$) saponin (1.5% of melt volume) hardener (1.8% of total gelatin) |

Samples of each of these monochrome coatings were imagewise exposed through a graduated density test object and processed at 100° F. according to a modified C-41 process using the following sequence of processing solutions: development, 3 min 15 sec in KODAK FLEXICOLOR Developer (Developer solution D-1); stop bath, 30 sec; bleach, 3 min in KODAK FLEXICOLOR Bleach II; wash, 3 min; fix, 4 min in KODAK FLEXICOLOR Fix; wash, 3 min; and stabilizer, 30 sec in KODAK PHOTOFLO solution. Developer solution D-1 is described below in Table VII

TABLE VII

| | |
|---|---|
| Anhydrous potassium carbonate | 34.30 g |
| Anhydrous sodium sulfite | 0.38 g |
| Potassium bicarbonate | 2.32 g |
| Potassium iodide | 1.20 mg |
| Sodium metabisulfite | 2.78 g |
| Sodium bromide | 1.31 g |
| Diethylaminetriaminepentaacetic acid pentasodium salt (40% solution) (KODAK Anti-calcium No. 8) | 8.43 g |
| Hydroxylamine sulfate (HAS) | 2.41 g |
| KODAK Color Developing Agent CD-4 2-((4-amino-3-methylphenyl)ethylamino)-ethanol sulfate (1:1 salt) | 4.52 g |
| Water to make 1 liter, pH 10.0 ± 0.05 @ 80° F. | |

Sensitometric parameters for the two coatings in Table VIII below show the coatings to be equivalent. Thus, the presence of the blocked developer in Layer C in the coating according to the invention had no detrimental effect.

TABLE VIII

| Coating | Dmin | Dmax | Contrast | Speed |
|---|---|---|---|---|
| With Layer C | 0.21 | 2.87 | 2.95 | 224 |

TABLE VIII-continued

| Coating | Dmin | Dmax | Contrast | Speed |
|---|---|---|---|---|
| Without Layer C | 0.21 | 2.87 | 2.95 | 224 |

Ten of the foregoing coatings with Layer C were then exposed as before and processed at 100° F. using a developer solution D-2, as described in Table IX.

TABLE IX

| | |
|---|---|
| Anhydrous potassium carbonate | 37.5 g |
| Anhydrous sodium sulfite | 4.0 g |
| Potassium iodide | 1.20 mg |
| Sodium bromide | 1.30 g |
| 1,3 Diamino-2-propanoltetraacetic acid | 2.50 g |
| Hydroxylamine sulfate | 2.41 g |
| KODAK Color Developing Agent CD-3 N-(2-((4-amino-3-methylphenyl)-ethylamino)ethyl)methane sulfonamide sulfate (2:3 salt) | 0.63 g |
| Water to make 1 liter, pH 10.00 ± 0.03 @ 80° F. | |

The developer bath had a total volume of 150 ml. The subsequent stop, wash, bleach and fix processing was done as described above. Fresh developer solution D-2 was put into the developer vessel, and ten coatings without Layer C were developed sequentially, as described above. Each processed strip was read on a densitometer, and the contrast was calculated from the density readings. The resulting contrasts, as a function of the sequence in which the strips were processed in the developer solution D-2, are illustrated in FIG. 1.

The contrast obtained during the processing sequence for the strips containing blocked developer 17 in Layer C steadily increased, showing that the developer solution was being made more active as a result of the release of developer from Layer C. The contrast obtained in the processing sequence of the control strips without Layer C remained constant over the course of processing the ten control strips. These results show that developer can be released from a layer on the back of the film to increase the rate of development, that is, to replenish the color developer.

EXAMPLE 2

Identical coatings to those of Example 1 were prepared, except that the level of blocked developer 17 in Layer C was increased to 1.98 mmol/m$^2$ and the silver halide emulsion in Layer B was changed to a silver chloride emulsion. Development of these two coatings in the KODAK FLEXICOLOR Developer yielded the sensitometric parameters described in Table X. These parameters show that the sensitometry of these two coatings was equivalent.

TABLE X

| Coating | Dmin | Dmax | Contrast | Speed |
|---|---|---|---|---|
| With Layer C | 0.13 | 2.73 | 4.02 | 251 |
| Without Layer C | 0.13 | 2.77 | 4.14 | 254 |

Figure 2:
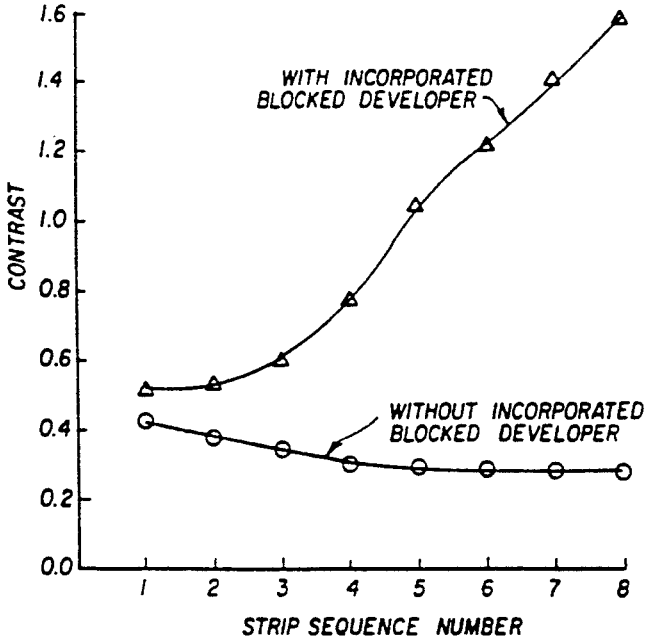
FIG. 2 is a comparison of contrast obtained for sequences of strips (with and without incorporated blocked developer for automatic replenishment) processed in a color developer solution, wherein the level of color developer was about 0.05 times the amount used according to the prior art.

Treatment of eight strips of each of these two coatings as described in the second part of Example 1, but this time using developer solution D-2, wherein the developing agent CD-3 was incorporated at a level of 0.315 g/l (0.05 times the normal amount). As shown in FIG. 2, when eight strips of the control coating, without a Layer C, were processed in sequence, the contrast of the strips became lower as the developer in the solution was depleted. When eight strips of the coating containing Layer C were processed in sequence, the contrast increased markedly.

These results also show that the developer released from a coated layer can replenish a developer solution. The rate of the depletion of developer depends on the amount of silver developed. Detailed knowledge of a particular film structure and performance is needed, but readily available, to determine the optimal amount of blocked developer to coat for a particular film and development process. Means for making such determinations are readily apparent to those skilled in the art.

EXAMPLE 3

Figure 3:
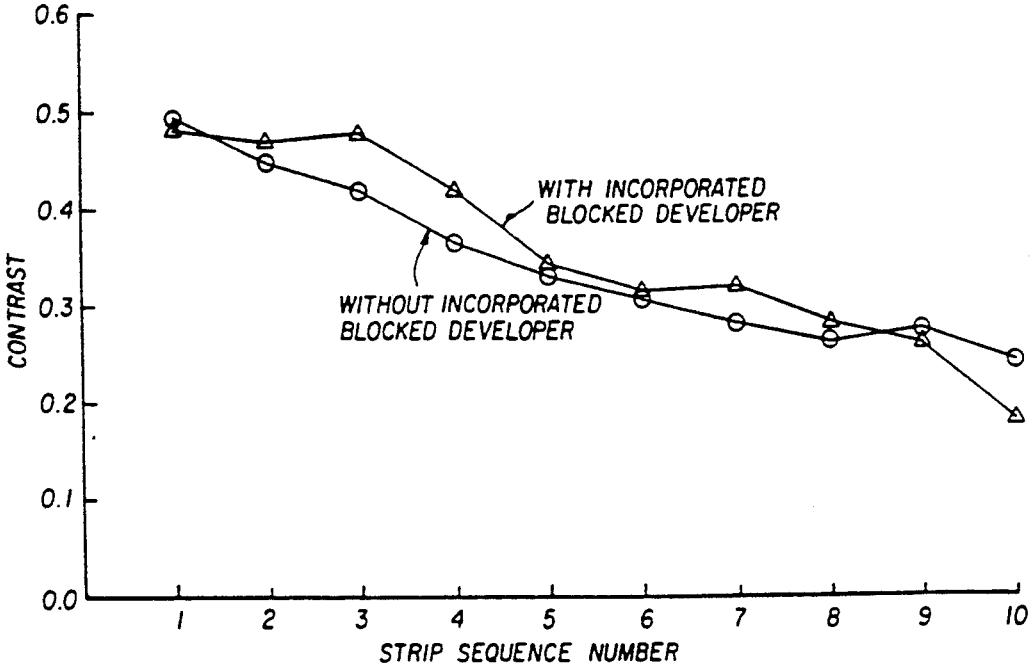
FIG. 3 is a comparison of contrast obtained as in FIG. 2, except that the developer solution contained no hydroxylamine sulfate as a dinucleophile.

The experiment described in Example 2 was repeated, except that developer solution D-2 was replaced with developer solution D-3. Developer solution D-3 was identical to solution D-2, except that no hydroxylamine sulfate was added to solution D-3. The same sequential processing illustrated in FIG. 2 was carried out, and these results are illustrated in FIG. 3. It is seen in FIG. 3 that in the absence of a nucleophile to initiate unblocking of the developer precursor, no effective replenishment is obtained.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support bearing at least one photographic silver halide emulsion layer and bearing on the opposite side of said support a layer comprising at least one blocked developing agent or precursor thereof.

2. A photographic element as claimed in claim 1, wherein said blocked developing agent has a structure according to the formula:

$$D-(T)_m-S$$

in which

D is a silver halide developer,

T is a timing group, m is an integer from 0 to 6 and denotes the number of timing groups connected in series, and S is a blocking group.

3. A photographic element as claimed in claim 2, wherein D is a color developer.

4. A photographic element as claimed in claim 3, wherein D is an unsubstituted or substituted p-phenylenediamine group or an unsubstituted or substituted p-aminophenol group.

5. A photographic element as claimed in claim 2, wherein S is an acyl group.

6. A photographic element as claimed in claim 5, wherein S is a β-ketoacyl group.

7. A photographic element as claimed in claim 6, wherein S is

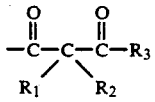

or

-continued

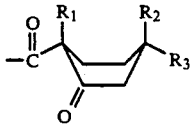

in which $R_1$, $R_2$ and $R_3$ are Independently H or an alkyl group having 1 to 20 carbon atoms.

8. A photographic element as claimed in claim 6, wherein S is

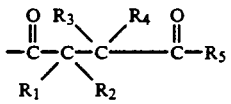

in which $R_1$, $R_2$, $R_3$, $R_4$ and $R_5$ are independently H or an alkyl group having 1 to 20 carbon atoms.

9. A photographic element as claimed in claim 2, wherein S is

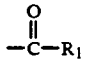

in which $R_1$ an unsubstituted or substituted alkyl, alkoxy, aryl or aryloxy group.

10. A photographic element as claimed in claim 2, wherein at least one of S and T is ballasted.

11. A photographic element as claimed in claim 2, wherein at least one of S, T and D has a substituent that increases the solubility of said blocked developing agent.

12. A photographic element as claimed in claim 1, wherein said blocked developing agent or precursor thereof is present in an amount from about 0.001 to 100 $g/m^2$.

13. A photographic element as claimed in claim 1, further comprising a dye-forming coupler associated with said silver halide emulsion.

14. A photographic element as claimed in claim 1, further comprising at least one non-photosensitive layer between said emulsion layer and said support, wherein said non-photosensitive layer comprises at least one blocked developing agent.

15. A multicolor photographic element comprising a support bearing a cyan dye image-forming unit comprising at least one red-sensitive silver halide emulsion layer having associated therewith at least one cyan dye-forming coupler, a magenta dye-image forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, and a non-photosensitive layer disposed on the side of said support opposite said blue-, green- and yellow-sensitive silver halide emulsion layers, wherein said non-photosensitive layer comprises at least one blocked developing agent or blocked developing agent precursor.

16. A process for replenishing developing solution and developing an image in a photographic element comprising a support, a photographic silver halide emulsion layer containing an imagewise distribution of developable silver halide grains, and a non-photosensitive layer comprising at least one blocked developing agent or blocked developing agent precursor, said non-photosensitive layer being coated on the side of said support on the side opposite said emulsion layer, said process comprising the step of contacting said element with a processing solution which comprises a nucleophile.

17. A process as claimed in claim 16, wherein said blocked developing agent has the structure $$D-(T)_m-S$$

in which

D is a silver halide developer,

T is a timing group, m is an integer from 0 to 6, and

S is a blocking group.

18. A process as claimed in claim 17, wherein D is a color developing agent.

19. A process as claimed in claim 18 wherein D is an unsubstituted or substituted p-phenylenediamine group or an unsubstituted or substituted p-aminophenol group.

20. A process as claimed in claim 17, wherein S is an acyl group.

21. A process as claimed in claim 20, wherein S is a β-ketoacyl group and said nucleophile is a dinucleophile.

22. A process as claimed in claim 21, wherein S is

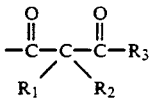

or

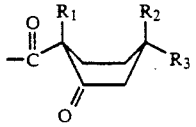

in which $R_1$, $R_2$ and $R_3$ are independently H or an alkyl group having 1 to 20 carbon atoms.

23. A process as claimed in claim 20, wherein S is

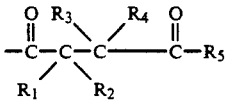

in which $R_1$, $R_2$, $R_3$, $R_4$ and $R_5$ are independently H or an alkyl group having 1 to 20 carbon atoms.

24. A process as claimed in claim 20, wherein S is

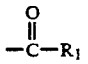

in which $R_1$ an unsubstituted or substituted alkyl, alkoxy, aryl or aryloxy group, and said nucleophile is a peroxide having the structure $$R_7-OOH$$

in which $R_7$ is H or an unsubstituted or substituted alkyl, aryl, alkaryl, aralkyl, acyl, sulfonyl, oxycarbonyl or borate group, or a salt thereof or a derivative thereof which is hydrolyzable to said peroxide in alkaline solution.

25. A process as claimed in claim 24, wherein $R_7$ in said peroxide is a group which is hydrolyzable in alkaline solution, whereby said peroxide forms hydrogen peroxide.

26. A process as claimed in claim 24, wherein said peroxide is hydrogen peroxide, a salt thereof or a derivative thereof which is hydrolyzable to hydrogen peroxide in alkaline solution.

27. A process for producing a photographic element which comprises the steps of providing a support, applying to said support a non-photosensitive layer comprising at least one blocked developing agent, and subsequently applying to said support on the side opposite the non-photosensitive layer a photographic silver halide emulsion layer.

* * * * *